US005547441A

United States Patent [19]

Mora

[11] Patent Number: 5,547,441

[45] Date of Patent: Aug. 20, 1996

[54] ADJUSTABLE RESISTANCE CORD WINDING EXERCISE METHOD

[75] Inventor: Raul Mora, Fort Lauderdale, Fla.

[73] Assignee: Alrama Enterprises, Inc., Dade City, Fla.

[21] Appl. No.: 345,850

[22] Filed: Nov. 28, 1994

Related U.S. Application Data

[62] Division of Ser. No. 113,065, Aug. 30, 1993, Pat. No. 5,380,261.

[51] Int. Cl.[6] ..... A63B 23/14

[52] U.S. Cl. ..... 482/46

[58] Field of Search ..... 482/44–46, 50, 482/93, 106–110; 273/319, 320, 327, 330–332

[56] References Cited

U.S. PATENT DOCUMENTS

| | | | |
|---|---|---|---|
| 588,350 | 8/1897 | Perkins | 482/93 X |
| 667,373 | 2/1901 | Thorngren | 273/320 |
| 1,556,794 | 10/1925 | Manson | 273/319 |
| 3,743,297 | 7/1973 | Dennis | 482/109 X |
| 3,982,755 | 9/1976 | Sarich | 482/46 X |

*Primary Examiner*—Richard J. Apley
*Assistant Examiner*—John Mulcahy
*Attorney, Agent, or Firm*—Oltman and Flynn

[57] ABSTRACT

An apparatus for exercising muscles of the fingers, hands, wrists and forearms, includes a shaft having a longitudinal axis, a flexible cord connected to the shaft and a weight member suspended from the flexible cord, so that a user can grasp and rotate the shaft about the longitudinal axis while positioning the shaft substantially horizontally to wrap and unwrap the cord around the shaft and thereby raise and lower the weight member. The apparatus also includes a hollow outer cylinder shorter than the shaft mounted substantially coaxially over the shaft and having a cord opening through which the cord passes, first and second outer cylinder end walls having central bores and first and second tubular end flanges extending outwardly from the outer cylinder and over the shaft, the first end wall being structurally connected to the outer cylinder, a first set screw in the first end flange for tightening to cause the outer cylinder to rotate in unison with the shaft so that the outer surface of the outer cylinder gathers and releases the cord, for increasing the distance between the longitudinal axis of rotation and the surface about which the cord is gathered to increase rotational resistance. An intermediate cylinder operates similarly. A method of exercising, using the above apparatus, includes the steps of grasping the shaft with fingertips or hands and rotating the shaft about the longitudinal axis to elevate the weight member and rotating the shaft about the longitudinal axis to lower the weight member. A method of exercising, using the above apparatus, includes the steps of grasping the shaft with one hand at the end opposite that to which the weight is attached and moving the shaft end bearing the weight in a circular path to induce a rotational or side to side resistance created by the weight member.

2 Claims, 8 Drawing Sheets

ADJUSTABLE RESISTANCE CORD WINDING EXERCISE METHOD

This application is a Division of application Ser. No. 08/113,065 filed Aug. 30, 1993 by the present inventor, now U.S. Pat. No. 5,380,261.

BACKGROUND OF THE INVENTION

1. Field of the Invention

The present invention relates generally to the field of exercise devices, and more specifically to hand, wrist and forearm exercise apparatus including a substantially horizontal shaft mounted to rotate about its longitudinal axis and a weight member suspended from a cord attached to the shaft midsection so that the user can grasp and rotate the shaft with one or both hands so that the cord wraps and unwraps around the shaft and raises and lowers the weight member, thereby exercising hand, wrist and arm muscle groups by working them alternately in opposing directions against the force of gravity acting on the weight member, the apparatus also including a hollow circular outer cylinder mounted coaxially over the shaft and having a cord passing opening in its midsection through which the cord extends, and having cylinder end walls each having a central bore, the central bores being bordered by first and second tubular flanges extending outward from the outer cylinder and over the shaft, a first end wall being connected to the outer cylinder, so that for minimal rotational resistance the outer surface of the shaft gathers and releases the weighted cord during shaft rotation, and for greater resistance, a first set screw in the first end flange is tightened to cause the outer cylinder to rotate together with the shaft so that the outer surface of the cylinder gathers and releases the cord, creating a greater distance between the axis of rotation and the cord gathering surface, the apparatus also optionally including a circular intermediate cylinder with a cord passing opening connected to the second end wall and rotatably mounted within the outer cylinder, which can be anchored to the shaft with a second set screw in the second end flange while the outer cylinder is released to rotate independently of the shaft, so that the outer surface of the intermediate cylinder gathers and releases the cord at an intermediate distance from the axis of rotation to create moderate rotational resistance, and the above-stated method of using the apparatus.

2. Description of the Prior Art

There have long been devices for exercising muscles in the upper extremities of the human body which cremate resistance to movement in one direction and virtually no resistance to movement in the opposing direction. Examples of these devices include spring-biased hand grips which are squeezed against resistance and then released, such as the Digital Hand Grip and the Forearm Trainer, both shown on page 9 of Dr. Leonard's HEALTH FEST catalog published in 1993. A problem with these single-direction exercise devices is that they create unbalanced muscle development, failing to exercise some muscles altogether. The resulting lack of balance in muscular strength can impair agility and coordination of movement.

It is thus an object of the present invention to provide an exercise apparatus which creates reversed, or two directional resistance to movement for balanced muscle development.

It is another object of the present invention to provide such an apparatus which permits selection of the magnitude of resistance through a fast and convenient alteration of mechanical advantage.

It is still another object of the present invention to provide such an apparatus which is suitable for therapeutic treatments and body conditioning programs based on isotonic exercising of the fingers, hands, wrists and forearms.

It is finally an object of the present invention to provide such an apparatus which is reliable and inexpensive to manufacture.

SUMMARY OF THE INVENTION

The present invention accomplishes the above-stated objectives, as well as others, as may be determined by a fair reading and interpretation of the entire specification.

An apparatus is provided for exercising muscles of the hand, wrist and forearm, including a shaft having a longitudinal axis, a flexible cord connected to the shaft and a weight member suspended from the flexible cord, so that a user can grasp and rotate the shaft about the longitudinal axis while positioning the shaft substantially horizontally to wrap and unwrap the cord around the shaft and thereby raise and lower the weight member. The apparatus also includes a hollow outer cylinder shorter than the shaft mounted substantially coaxially over the shaft and having a cord opening through which the cord passes, first and second outer cylinder end walls having central bores and first and second tubular end flanges extending outwardly from the outer cylinder and over the shaft, the first end wall being structurally connected to the outer cylinder, a first set screw in the first end flange for tightening to cause the outer cylinder to rotate in unison with the shaft so that the outer surface of the outer cylinder gathers and releases the cord, for increasing the distance between the longitudinal axis of rotation and the surface about which the cord is gathered to increase rotational resistance. The apparatus also includes an intermediate cylinder connected to the second end wall and rotatably mounted within the outer cylinder and having a cord opening through which the cord passes, so that the intermediate cylinder can be anchored to the shaft with a second set screw in the second end flange so that the intermediate cylinder rotates in unison with the shaft and the cord is gathered around the outer surface of the intermediate cylinder, at an intermediate distance from the axis of rotation to create moderate rotational resistance.

An apparatus is also provided for exercising muscles of the hand, wrist and forearm including a shaft having a longitudinal axis and a weight member joined to a first end of the shaft, so that one can grasp and rotate the shaft about the longitudinal axis to rotate the weight member together with the shaft and thereby overcome the rotational resistance created by the rotational inertia of the weight member.

An apparatus is also provided for exercising muscles of the hand, wrist and forearm, including a shaft having a longitudinal axis, a radial rod perpendicularly joined at a first end to the shaft and a weight member attached to the radial rod and spaced apart from the shaft, so that one can grasp and rotate the shaft to rotate the weight member around the shaft and thereby raise and lower the weight member.

A method is provided of exercising the hands and wrists, using the above described apparatus, including the steps of grasping the shaft with a hand and rotating the shaft about the longitudinal axis to elevate the weight member and rotating the shaft about the longitudinal axis to lower the weight member. The method may include the additional step of changing the magnitude of rotational resistance by relocating the weight member along the radial rod to vary the distance between the weight member and the longitudinal axis of the shaft.

BRIEF DESCRIPTION OF THE DRAWINGS

Various other objects, advantages and features of the invention will become apparent to those skilled in the art from the following discussion taken in conjunction with the following drawings, in which.

DETAILED DESCRIPTION OF THE PREFERRED EMBODIMENTS

Figure 1:
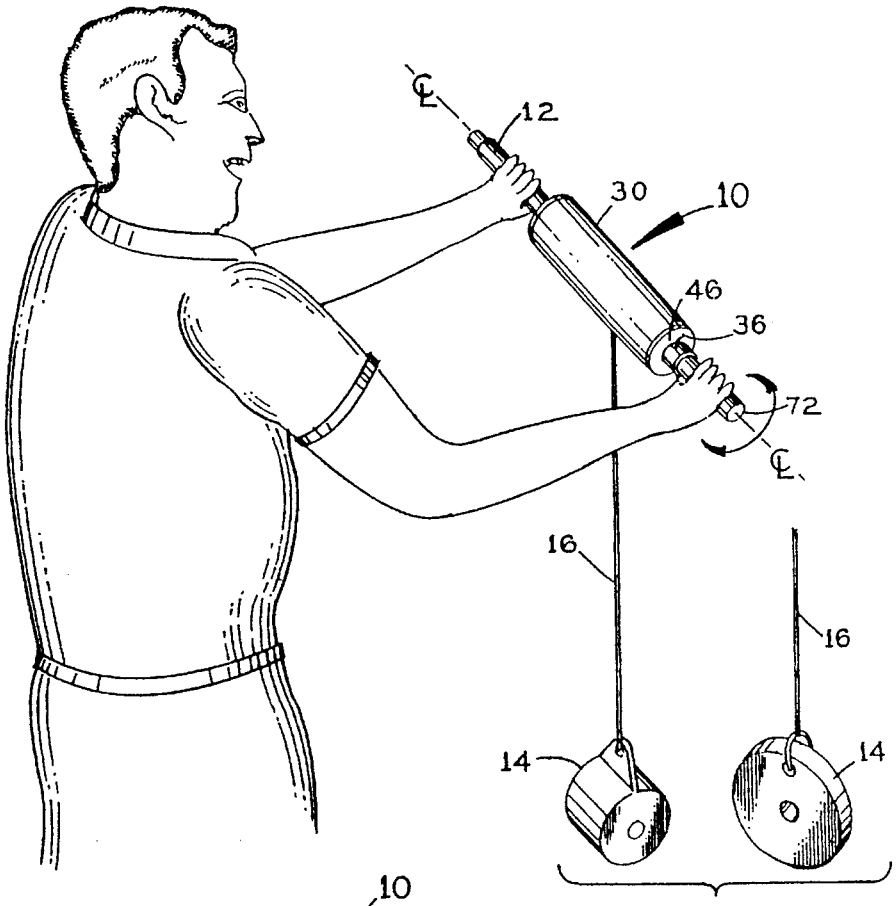
FIG. 1 is a perspective view of the first embodiment of the inventive apparatus being operated by the user.
Figure 2:
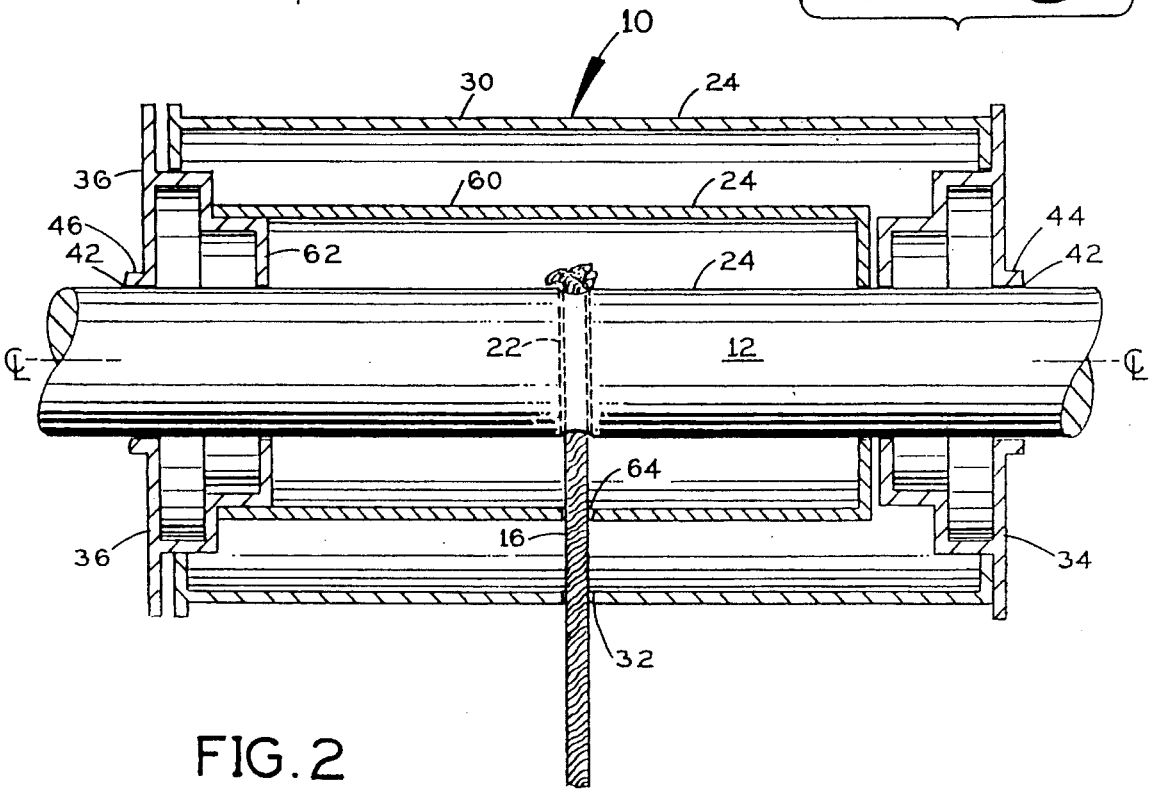
FIG. 2 is a cross-sectional side view of the cylinders surrounding the shaft, revealing the cord attachment to the shaft.
Figure 3:
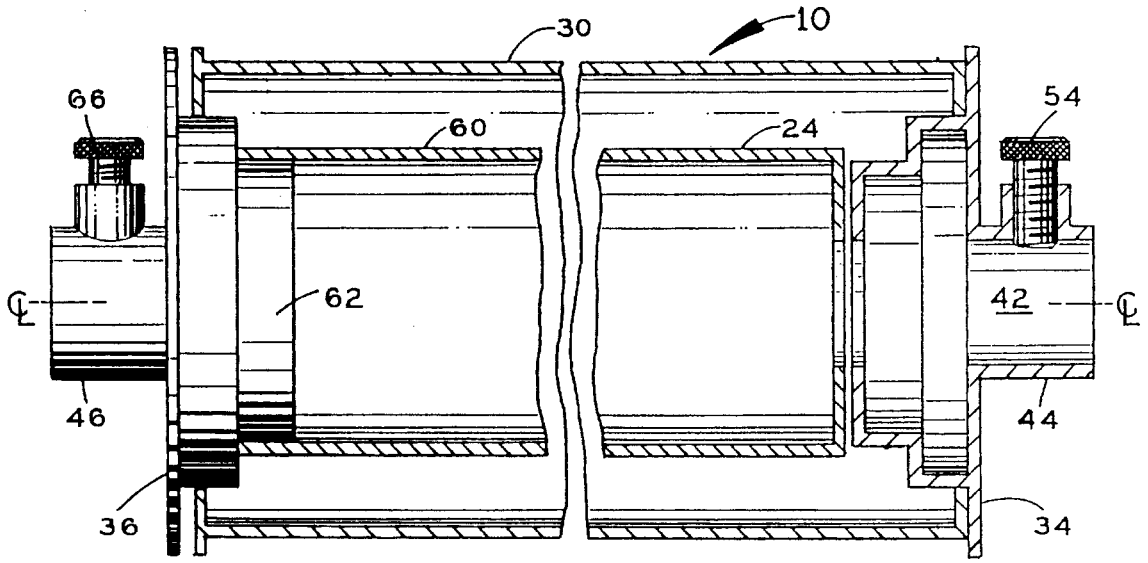
FIG. 3 is a cross-section side view as in FIG. 2, with the intermediate section cut out and the end flanges and set screws shown.
Figure 4:
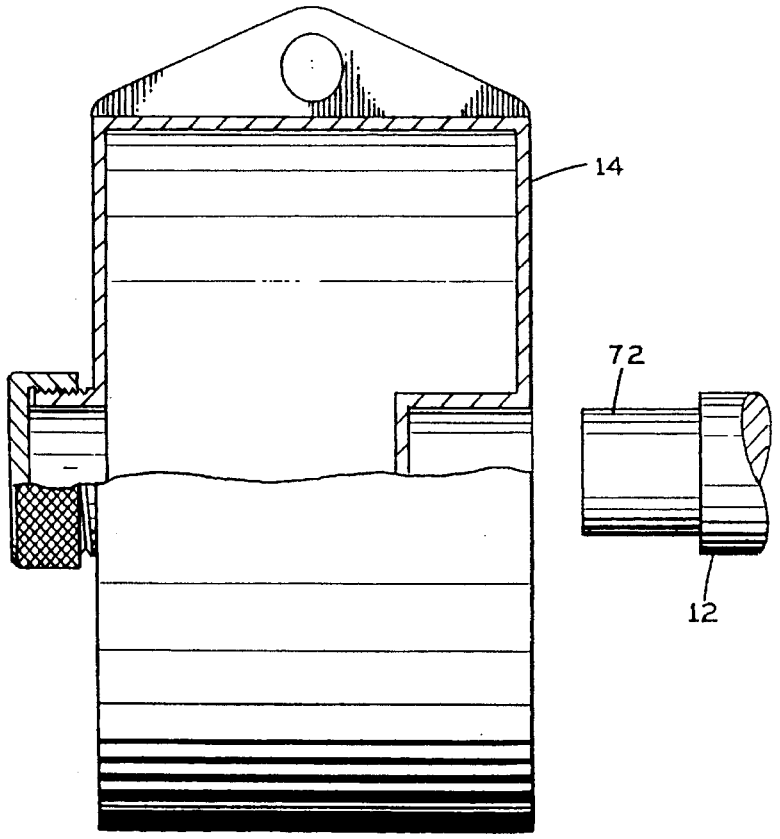
FIG. 4 is a view of a weight member to suspend from the cord.
Figure 5:
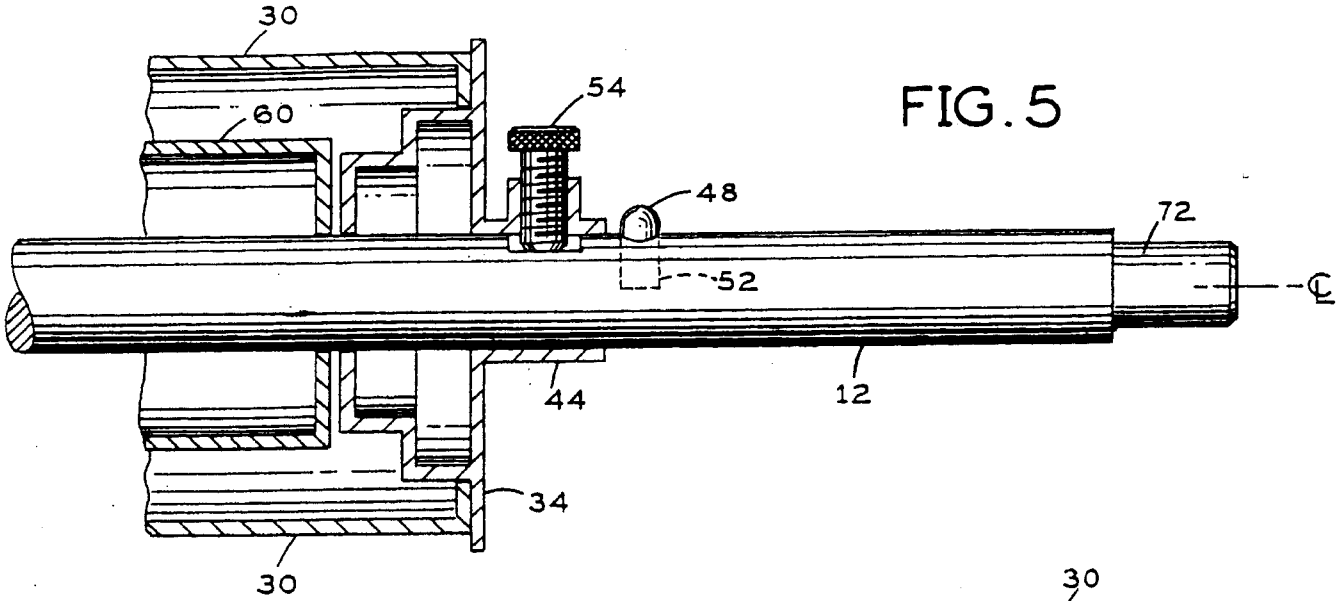
FIG. 5 is a cross-sectional side view of an end of the cylinders showing the set screw extending into a recess in the shaft for improved holding, and showing a reduced cross-section end portion of the shaft on which a weight member can be fitted.
Figure 6:
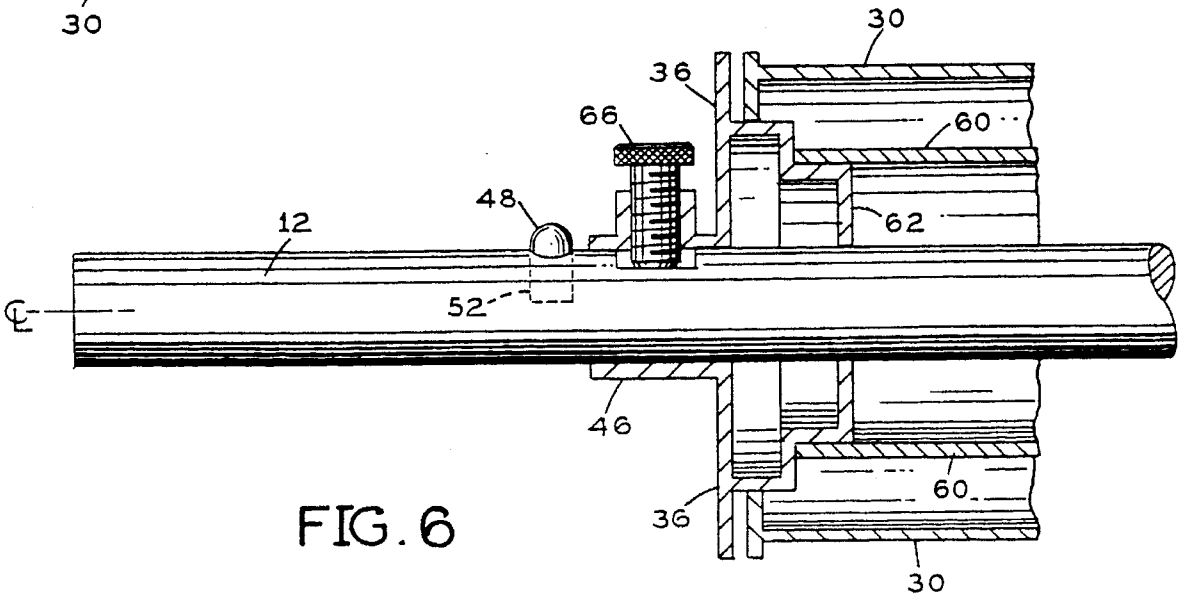
FIG. 6 is a view as in FIG. 5 of the other end of the cylinders.
Figure 7:
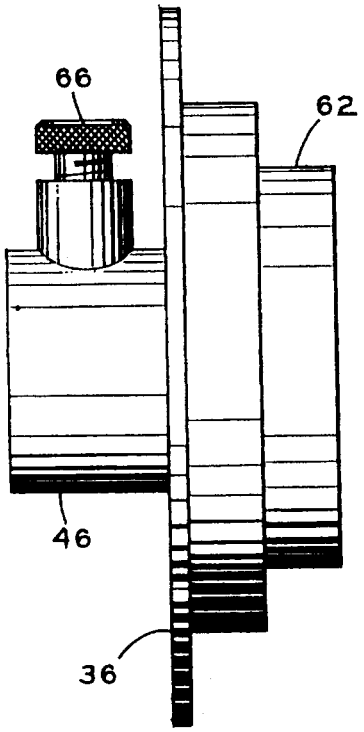
FIG. 7 is a side view of an outer cylinder side and end flange.
Figure 7A:
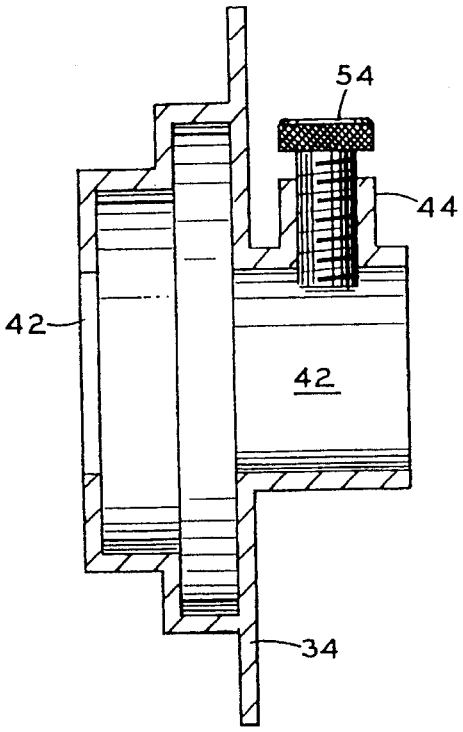
FIG. 7*a* is a cross-sectional side view of the structure shown in FIG. 7.
Figure 7B:
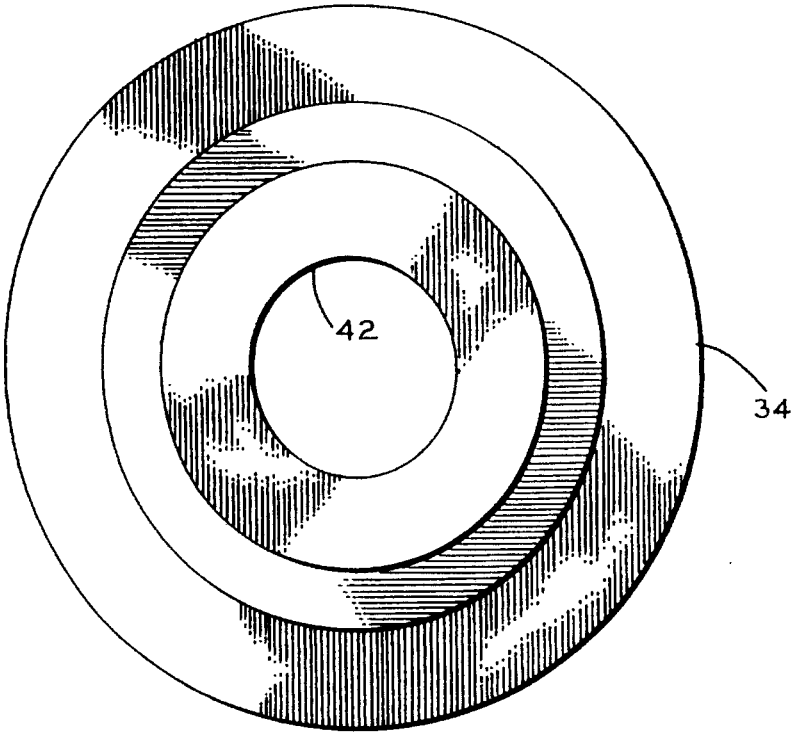
FIG. 7*b* is a front view of the structure shown in FIG. 7.
Figure 8:
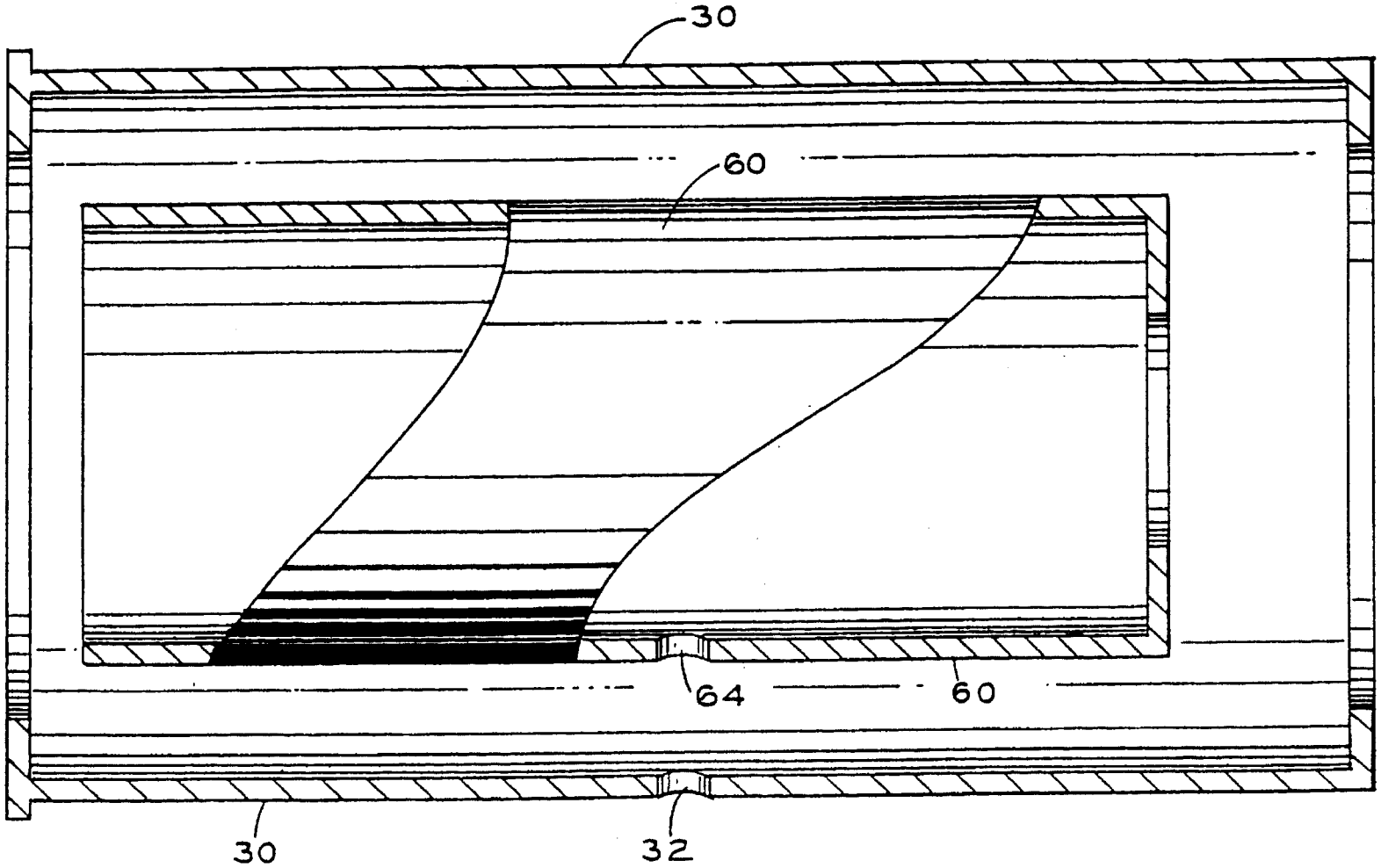
FIG. 8 is a cross-sectional side view of the outer and intermediate cylinders in their functioning positions relative to each other.
Figure 9:
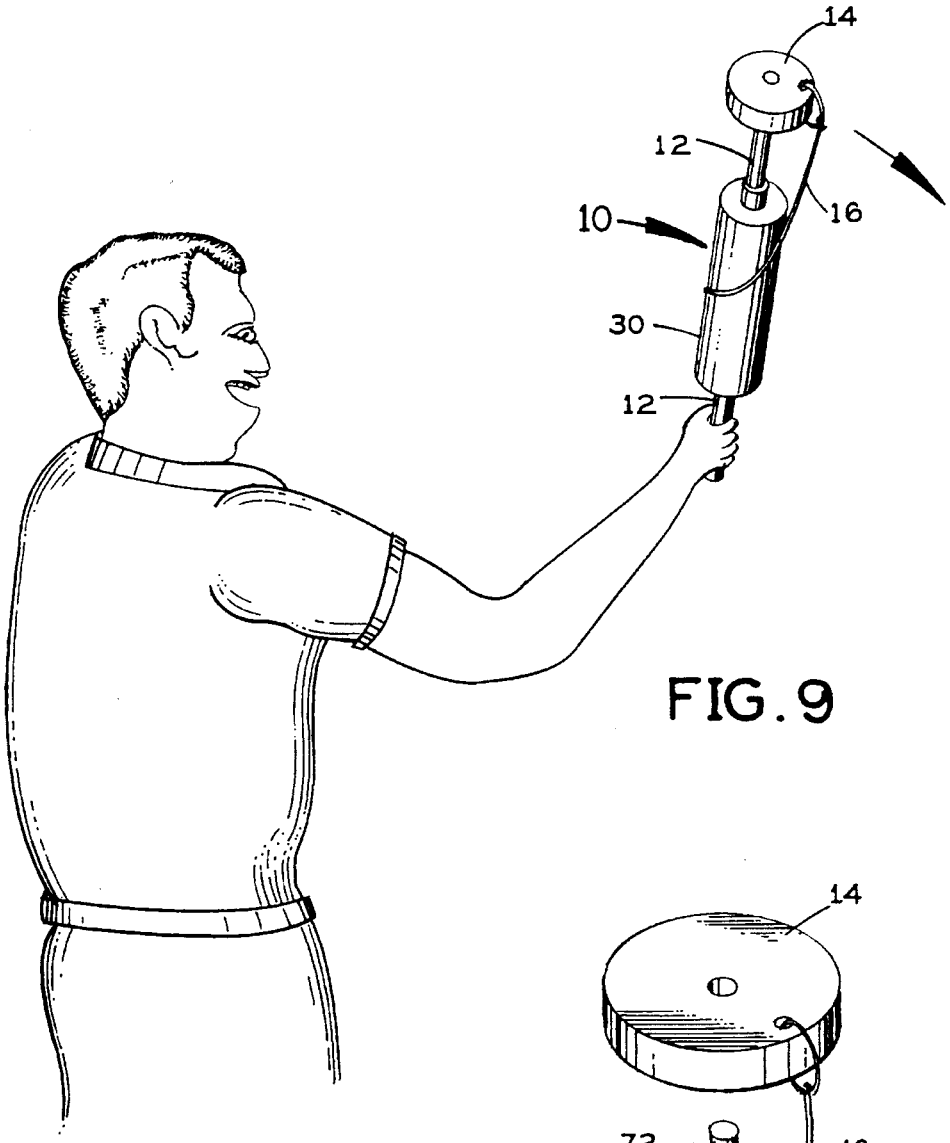
FIG. 9 is a perspective view of the second embodiment of the inventive apparatus being operated by a user.
Figure 9B:
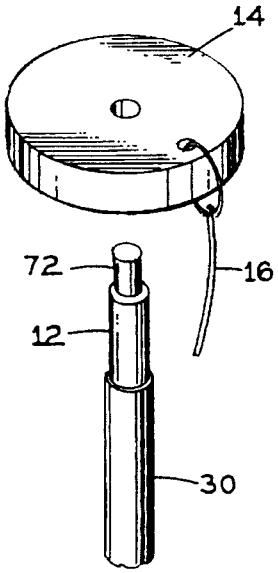
FIGS. 9*a* and 9*b* show a resistance creating device and a weight member, respectively, mounted on the shaft.
Figure 9A:
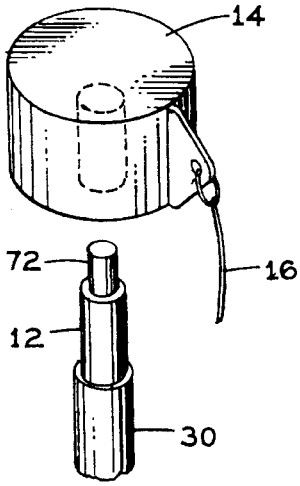

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–11*b*, an exercise apparatus 10 is disclosed for balanced strengthening of muscles of the fingers, hands, wrists and forearms. Apparatus 10 includes a substantially horizontal shaft 12 for rotating about its longitudinal axis L, and a weight member 14 suspended from a flexible cord 16 fit through a diametric hole 22 in the shaft 12 midsection and tied in place. See FIGS. 1 and 2. To use apparatus 10 the user grasps shaft 12 about its longitudinal axis L with finger tips or hand at each end and rotates shaft 12 in one direction so that cord 16 unwraps completely from the outer gathering surface 24 of shaft 12 and lowers weight member 14. The user continues to rotate shaft 12 in the same direction so that cord 16 wraps around gathering surface 24 in the opposite wrapping direction and raises weight member 14. To complete one full exercise sequence, shaft 12 is then rotated in the opposite direction to lower and to raise weight member 14 in the same manner. In this way, finger, hand, wrist and arm muscle groups are exercised by working them in opposite directions against the force of gravity on weight member 14 in a balanced way. Balance is assured because opposite muscles are used to obtain opposite rotations and the distance of raising is always equivalent to the distance of lowering weight member 14.

In addition to a balanced workout, apparatus 10 also provides convenient selection of the magnitude of resistance, without changing weight member 14. This selection is accomplished by extending the distance of the cord 16 gathering surface 24 from the axis of rotation L, with multiple circular cylinders mounted coaxially around shaft 12.

A hollow circular outer cylinder 30 shorter than shaft 12 is mounted coaxially over shaft 12 and has a cord 16-passing opening 32 in its midsection through which cord 16 hangs and slides. First and second outer cylinder end walls 34 and 36 each have central bores 42 with first and second tubular end flanges 44 and 46 extending outward from outer cylinder 30 and over shaft 12. See FIGS. 2–7*b*. First end wall 34 is structurally connected to outer cylinder 30. Stop pins 48 are pressed into holes 52 in shaft 12 adjacent flanges 44 and 46 to stop cylinder 30 from moving axially on shaft 12. See FIGS. 5 and 6. To exercise with maximum resistance, a first set screw 54 in first flange 44 is tightened to cause outer cylinder 30 to rotate together with shaft 12 so that the outer gathering surface 24 of cylinder 30 gathers and releases cord 16. This configuration increases the distance between the axis of rotation L and the gathering surface 24.

A circular intermediate cylinder 60 is connected to the second end wall 36 on hub 62. See FIGS. 2, 3 and 8. Intermediate cylinder 60 also has a cord passing opening 64, which can be anchored to shaft 12 with a second set screw 66 in second end flange 46. Intermediate cylinder 60 is used by tightening second set screw 66 and loosening first set screw 54 to release outer cylinder 30 to rotate independently of shaft 12. This permits the outer gathering surface 24 of intermediate cylinder 60 to gather and release cord 16 at a medium distance from the axis of rotation L to create moderate rotational resistance.

Second Preferred Embodiment

A weight member 14 or source of resistance such as a braking device is fit over a reduced cross-sectional end portion 72 of shaft 12. See FIG. 9. Weight member 14 in this instance creates resistance to movement with its rotational inertia rather than with its weight.

Third Preferred Embodiment

Figure 10:
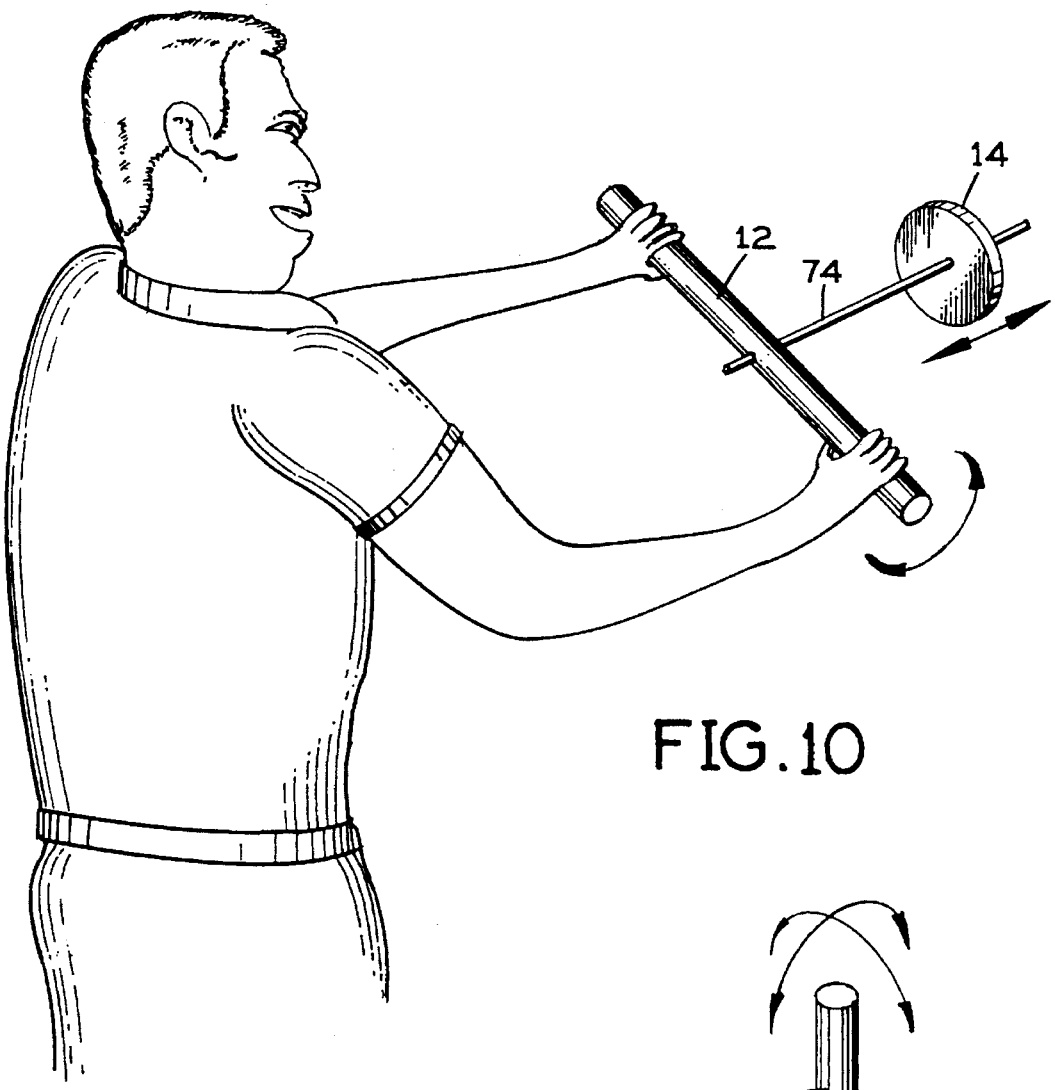
FIG. 10 is a perspective view of the third preferred embodiment being operated by a user.
Figure 10A:
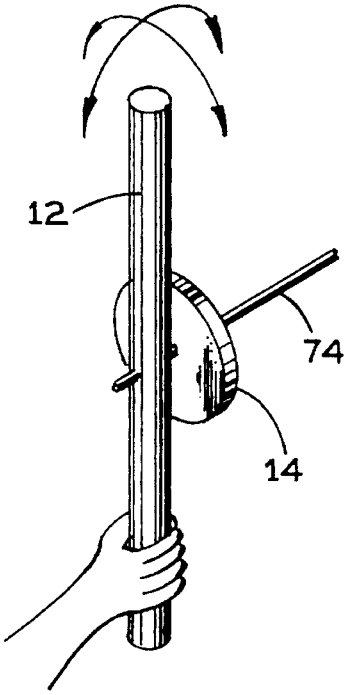
FIG. 10*a* shows how the weight member can be slid closer to the shaft for reduced rotational resistance.
Figure 11:
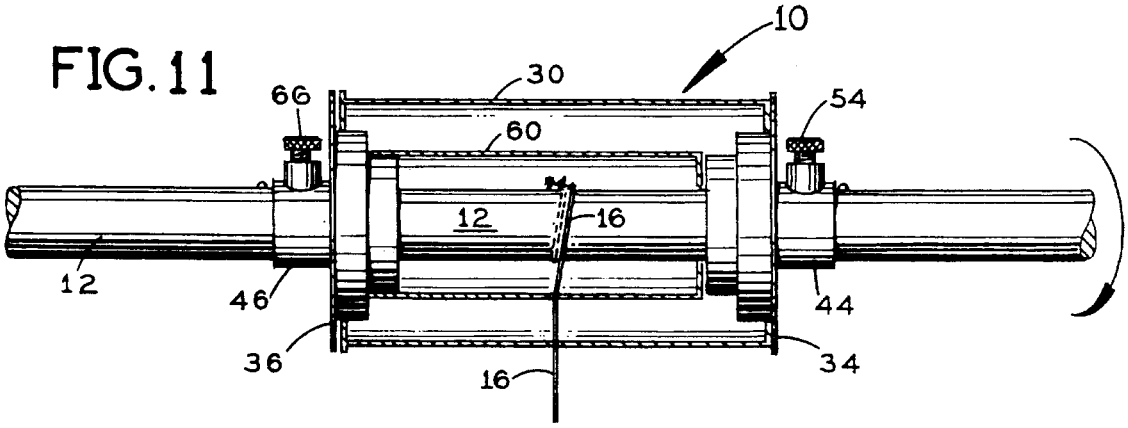
FIG. 11 is a cross-sectional side view of the first embodiment of the inventive apparatus showing the mode of operation where the cord wraps around the shaft for minimal rotational resistance.
Figure 11A:
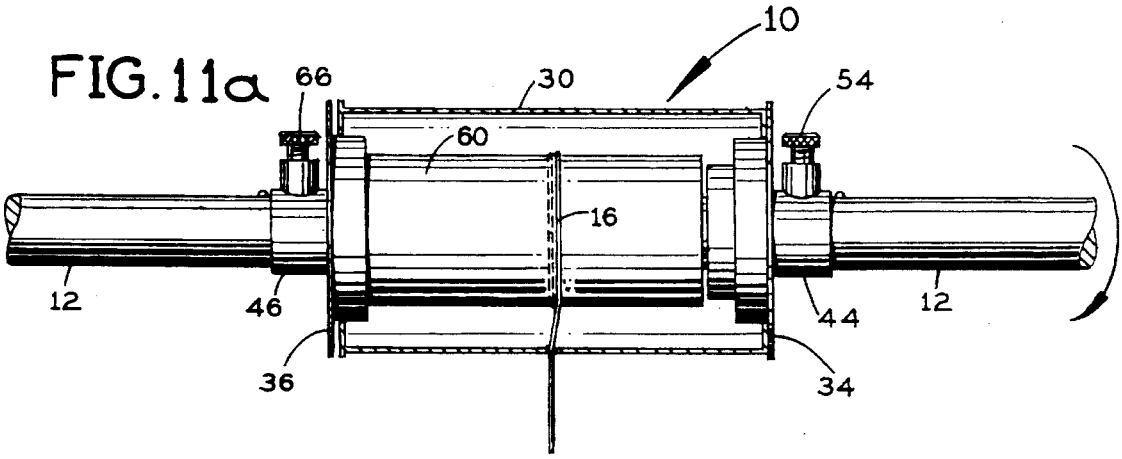
FIG. 11*a* is a cross-sectional side view of the inventive apparatus showing the mode of operation where the cord wraps around the intermediate cylinder for moderate rotational resistance.
Figure 11B:
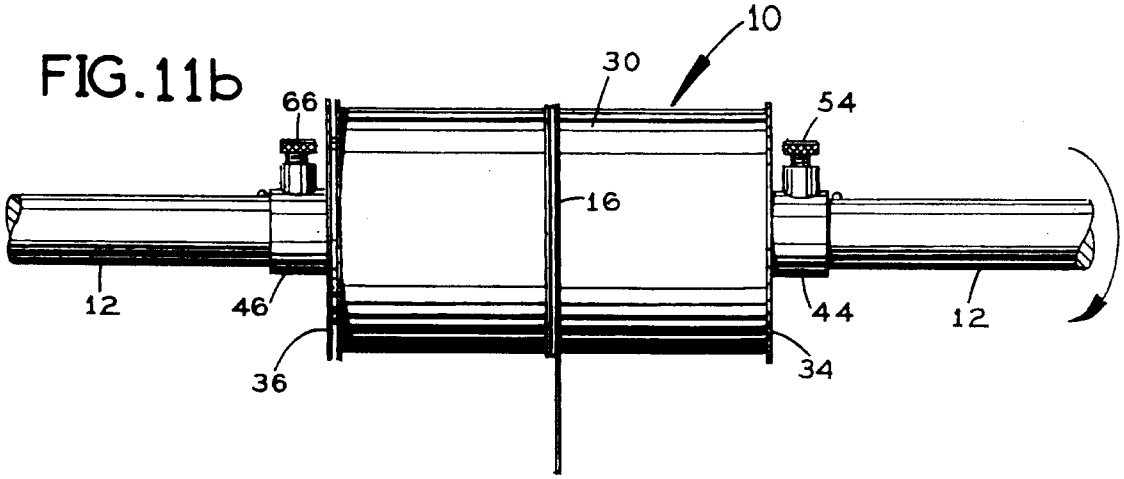
FIG. 11*b* is a side view showing the mode of operation where the cord wraps around the outer cylinder for maximum rotational resistance.

Weight member 14 may still alternatively be connected to a remote end of a radial rod 74 extending perpendicularly from shaft 12. See FIGS. 10 and 10*a*. Resistance is created once again by rotating shaft 12 axially, and in this instance the weight of weight member 14 at the remote end of radial rod 74 creates a torque for the muscles to overcome.

Method

In practicing the invention, the following method may be used. A user grasps shaft 12 of apparatus 10 with one or both hands and rotates shaft 12 in a given direction until weight member 14 is at minimum elevation. Minimum elevation may be where cord 16 is, unwrapped from gathering surface 24, is substantially rectilinear and vertical. The user continues to rotate shaft 12 in the same direction so that cord 16 wraps in the opposite wrapping direction around shaft 12 and raises weight member 14 to a maximum elevation. Maximum elevation may be where weight member 14 strikes outer cylinder 30. This completes one half of the exercise sequence. Then the user rotates shaft 12 in the opposite direction until weight member 14 is again at its minimum elevation, and continues to rotate shaft 12 in this opposite direction until weight member 14 again reaches maximum elevation. This completes the second half of the exercise sequence. An additional step is to change the magnitude of resistance by tightening first set screw 54 or second set screw 66 to engage outer cylinder 30 or intermediate cylinder 60, respectively, to rotate with shaft 12. See FIGS. 11–11B.

While the invention has been described, disclosed, illustrated and shown in various terms or certain embodiments or modifications which it has assumed in practice, the scope of the invention is not intended to be, nor should it be deemed to limited thereby and such other modifications or embodiments as may be suggested by the teachings herein are particularly reserved especially as they fall within the breadth and scope of the claims here appended.

I claim as my invention:

1. A method of exercising the fingers, hands, wrists and forearms, using an apparatus comprising a shaft having a longitudinal axis, a flexible cord connected to said shaft and a weight member suspended from said flexible cord, a hollow outer cylinder shorter than said shaft mounted substantially coaxially over said shaft and having a cord opening through which said cord passes, first and second outer cylinder end walls having central bores and first and second tubular end flanges extending outwardly from said outer cylinder end walls and over said shaft, said first end wall being structurally connected to said outer cylinder, and a first set screw in said first end flange for tightening to cause said outer cylinder to rotate in unison with said shaft so that the outer surface of said outer cylinder gathers and releases said cord, comprising the steps of:

grasping said shaft with at least one hand and rotating said shaft about said longitudinal axis to lower said weight member, rotating said shaft about said longitudinal axis to elevate said weight member, and changing the magnitude of rotational resistance by tightening said first set screw to engage said outer cylinder to the shaft to gather said cord about said outer cylinder.

2. A method of exercising the fingers, hands, wrists and forearms, using an apparatus comprising a shaft having a longitudinal axis, a flexible cord connected to said shaft and a weight member suspended from said flexible cord, a hollow outer cylinder shorter than said shaft mounted substantially coaxially over said shaft and having a cord opening through which said cord passes, first and second outer cylinder end walls having central bores and first and second tubular end flanges extending outwardly from said outer cylinder end walls and over said shaft, said first end wall being structurally connected to said outer cylinder, and a first set screw in said first end flange for tightening to cause said outer cylinder to rotate in unison with said shaft so that the outer surface of said outer cylinder gathers and releases said cord, a hollow intermediate cylinder shorter than said shaft mounted substantially coaxially over said shaft and having a cord opening through which said cord passes, first and second intermediate cylinder end walls having central bores and first and second tubular end flanges extending outwardly from said intermediate cylinder end walls and over said shaft, said second end wall being structurally connected to said intermediate cylinder, and a second set screw in said second end flange for tightening to cause said intermediate cylinder to rotate in unison with said shaft so that the outer surface of said intermediate cylinder gathers and releases said cord, comprising the steps of:

grasping said shaft with at least one hand and rotating said shaft about said longitudinal axis to lower said weight member, rotating said shaft about said longitudinal axis to elevate said weight member, changing the magnitude of rotational resistance by tightening said first set screw to engage said outer cylinder to the shaft to gather said cord about said outer cylinder, and changing the magnitude of rotational resistance by tightening said second set screw to engage said intermediate cylinder to the shaft, to gather said cord about said outer surface of the intermediate cylinder.

* * * * *